United States Patent [19]

Malyon et al.

[11] Patent Number: 5,053,819

[45] Date of Patent: Oct. 1, 1991

[54] COPIER WITH IMPROVED PLATEN FOR BOOKS TO BE COPIED

[75] Inventors: Brian R. Malyon, Bracknell; Simon E. Lugg, Bermondsey, both of United Kingdom

[73] Assignee: Select Information Systems Limited, Berkshire, England

[21] Appl. No.: 572,954

[22] PCT Filed: Mar. 23, 1989

[86] PCT No.: PCT/GB89/00322

§ 371 Date: Sep. 12, 1990

§ 102(e) Date: Sep. 12, 1990

[87] PCT Pub. No.: WO89/09434

PCT Pub. Date: Oct. 5, 1989

[30] Foreign Application Priority Data

Mar. 26, 1988 [GB] United Kingdom ..... 8807268

[51] Int. Cl.[5] ..... G03G 21/00; G03G 15/00

[52] U.S. Cl. ..... 355/230; 355/25; 355/75; 355/82

[58] Field of Search ..... 355/25, 75, 82, 230

[56] References Cited

U.S. PATENT DOCUMENTS 2,878,740 1/1958 Hodges .

3,609,030 9/1971 Sugarman ..... 355/25

4,415,255 11/1983 Huber et al. ..... 355/75 X

*Primary Examiner*—Joan H. Pendegrass

*Assistant Examiner*—P. J. Stanzione

*Attorney, Agent, or Firm*—Lee, Mann, Smith, McWilliams & Sweeney

[57] ABSTRACT

A photocopier for books has a casing on whose top surface is mounted a platten. The platten is set back from the front of the casing, and it extends to a downwardly inclined support surface adapted to support the half of an opened book whose other half is to be copied. In a modification of the copier a step or recess is formed between the platten and the support surface, to enable the sloping part of the book adjacent to its spine to extend or splay outwards, thereby avoiding damage to the spine.

9 Claims, 3 Drawing Sheets

COPIER WITH IMPROVED PLATEN FOR BOOKS TO BE COPIED

FIELD OF INVENTION

This invention relates to copiers, and concerns in particular a xerographic photocopier adapted to facilitate the copying of books.

BACKGROUND TO THE INVENTION

The small to medium size photocopying machine usually has what is called a "straight-through" paper path. Thus, the plain paper onto which the orginal is to be copied is fed in a straight line through the copier from one end (where it is automatically loaded in from a hopper or cassette) to the other (where it is ejected into a collecting tray). As it progresses through the machine the paper is first contacted with a powder-bearing charged photosensitive surface and then delivered to and though a powder fusing section. The difficulty when copying books, is that the book must be opened wide enough to allow it to be placed face down flat on the glass platten, and this usually results in damage to the spine of the book, as the book is flattened out.

Various attempts have been made to deal with this, but none are particularly successful. In one type of copier, for example, the platten is positioned so as to extend right up to the very left-hand edge of the machine. A book may therefore be copied by placing it face down on the platten with only one half (one page) on the platten itself, the other half hanging down the vertical side of the machine, thereby avoiding the need to "flatten" the book. Extending the platten right up to the left-hand edge does create problems since it it difficult to arrange the optics of the imaging system such that the extreme left edge area of the original is properly seen and imaged onto the photosensitive surface, especially where reduction or enlargement is required. Furthermore the weight of the hanging portion of the book can cause the book to fall if the operator lets go without thinking.

Moreover, a trivial but irritating problem arising from the very nature of a straight-through paper system is that necessarily the hanging-down portion of a book may easily block the exit path of the formed copy.

SUMMARY OF THE INVENTION

The present invention proposes another solution to the problem of copying books, which solution avoids, or at least mitigates, the difficulties. More specifically, in a copier in which the imaging optics and paper feed, require the original to be aligned with (indexed on, or referenced to) the near edge of the platten, the casing of the copier is cut away in the region of upper near edge so as to slope outwardly and downwardly, to provide an inclined surface on which the half of a book which is not being copied can rest whilst the other half is being copied.

The invention thus allows a book to be copied—without being opened out flat—by placing the relevant page on the platten with its spine edge aligned with the near edge of the platten, and supporting the other half of the book on the inclined front surface.

One embodiment of the invention thus comprises a photocopier having a box-like casing including, from the operator's viewpoint, left, right, near and far sides and a top surface in which is mounted a platten, wherein the platten is set well back from the casing's front side, and the near top edge of the casing slopes away from the platten to produce a downwardly inclined book support surface which extends from the platten near edge.

In view of the present casing shape, the imaging system and certain other internal components may require modification and internal re-positioning compared with an otherwise conventional copier employing the same system. For example, where the copier is one using a scanning lamp on a slider rail, with light sensors and a blanking lamp (preventing excess toner usage), it will generally be necessary to move the lamp and its rail towards the far side; to raise the level of the platten, and move it towards the far side; to re-focus the optics; and to reposition the sensors and modify the blanking lamp lighting sequence.

Moreover, where the housing in the region of the top surface area adjacent the near edge of the platten would normally carry the copier controls (with various components beneath them), these will all need to be moved elsewhere.

Additionally, it may also be necessary slightly to reposition the paper feed system (both the cassettes, or other paper holders, and the single sheet feed apparatus).

In the copier of the invention the platten is set well back from the near side of the casing in order to allow the near top edge to be sufficiently deeply cut away. In most modern copiers the platten is usually set back about 10 to 15 cm (4 to 6 in), and, depending on the angle of incline required, a further 2 to 5 cm (1 to 2 in) may be sufficient.

In order to ease the problems of mounting the imaging and other system components inside the casing, the inclined book support surface should slope at a reasonably shallow angle, rather than a steep one, so that the casing can be significantly wider (near side to far side) a few centimeters below the platten. With these points in mind, the platten-to-sloping-surface internal angle (the "under" angle) is desirably at least 110° (so as not to be too steep) and at most 140° (so as not to be too "flat"). An angle in the range 125° to 130°, particularly 127° seems by experiment to be appropriate.

Advantageously a recess or step is provided along the edge between the platten and the inclined book support.

The recess preferably includes a horizontal portion extending to the inclined support an upright portion extending to the platten.

The upright portion may be vertical, or alternatively it may be inclined to the platten.

It has been found that the recess provides a surprising improvement in reducing damage to the spine of a book to be copied in that it enables the inner portion of the supported half of the book to splay outwards into the recess, thereby preventing excess forced opening of such inner portion adjacent the spine. Additionally it has been found that the recess also has the advantage of allowing improved copying of the part of the book nearest the spine.

It is desirable that the sloping support surface be of such an extent that no common size of book will, when in position, project beyond the bottom edge of the sloping surface.

The entire length of the near top edge of the casing may be cut away to include the book support surface, enabling the sloping parts at each side of the inclined book support to be used for the keyboard or controls.

Alternatively, however, it may only be necessary for the platten-adjacent part to be cut away, so that the rest of the near top edge, to the left and right of the platen, can remain generally rectilinear and conventional, so providing two areas of top surface that can usefully bear the controls, indicators, and so on.

BRIEF DESCRIPTION OF THE DRAWINGS

Embodiments of the invention will now be described, though only by way of illustration, with reference to the accompanying drawings in which.

Figure 1:
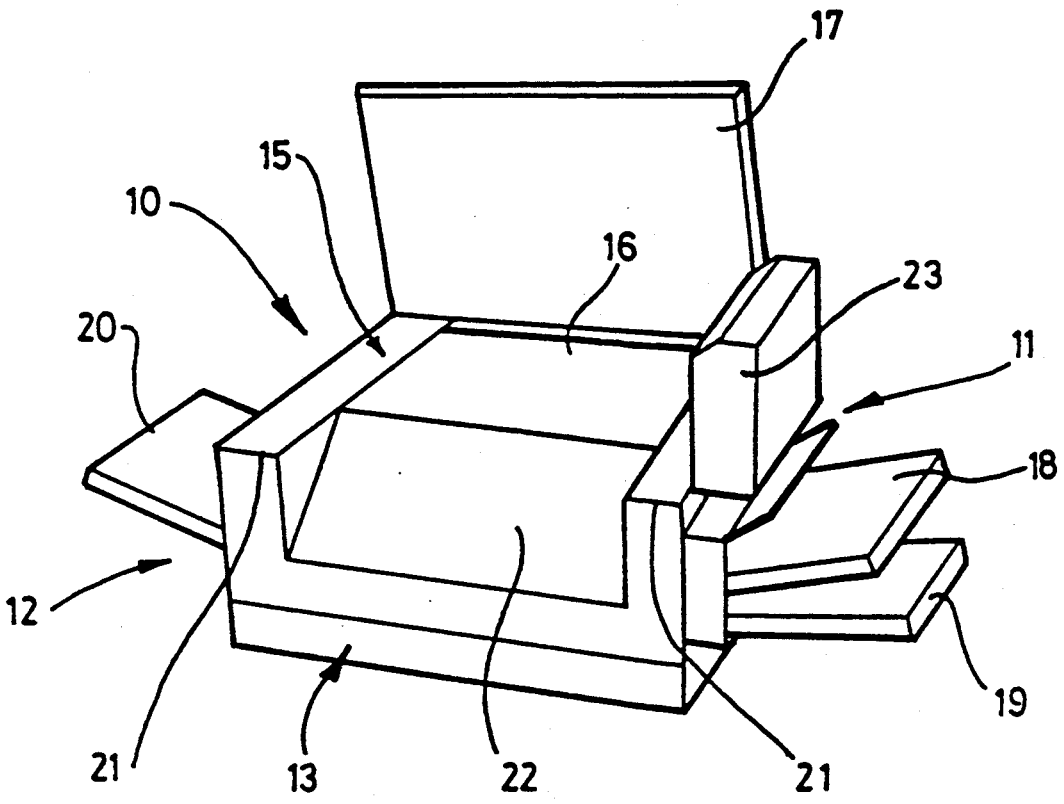
FIG. 1 shows a diagrammatic perspective view from above and in front of a photocopier according to the invention.
Figure 2A:
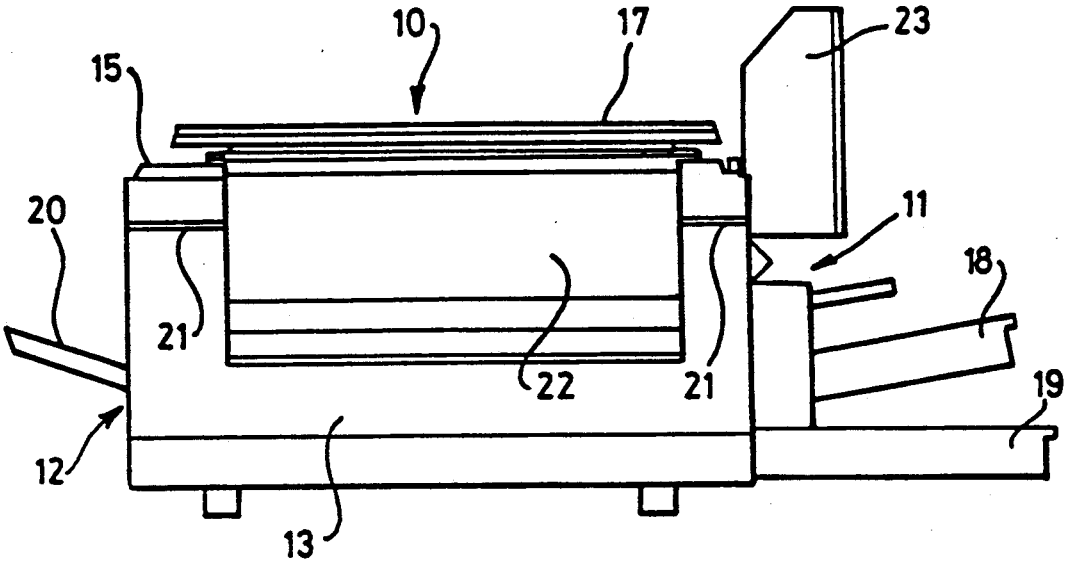
FIGS. 2A and 2B shows diagrammatic side and end views of the copier of FIG. 1.

The photocopier shown in the FIGS. 1 and 2 is housed in a box-like container or casing 10 with right and left sides 11, 12, near and far sides 13, 14, and a top surface 15 in which there is mounted a platten 16. It also has a lid 17 hinged at the far edge, and opening upwards and backwards. A paper path (not shown) extends from right to left in FIGS. 1 and 2A along which paper travels from one or other of two cassettes 18, 19 to a collecting tray 20 via the photosensitive surface and the fuser (neither of which is shown).

Figure 2B:
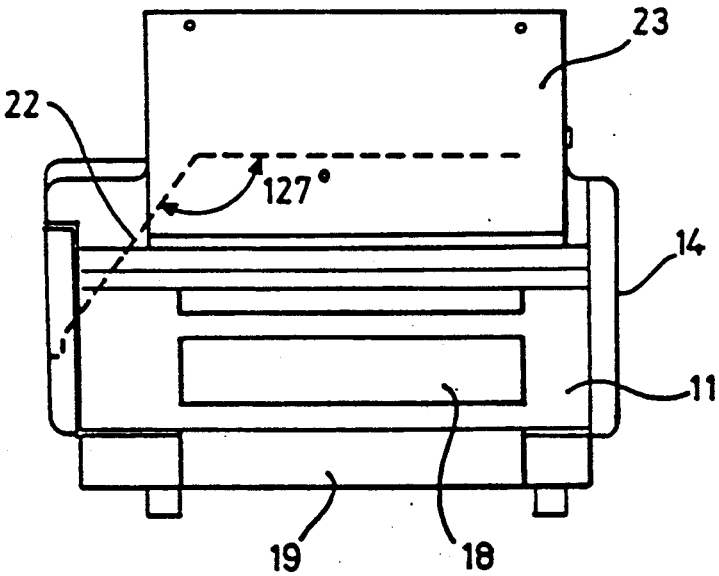

In accordance with the invention the platten 16 is set well back from the near top "edge" 21 of casing, and adjacent the platten, this edge support surface 22 extends in a downwards manner at an internal, "under" angle of 127° to the platten (see FIG. 2B).

The controls, indicators, and associated components and wiring are in a housing 23 mounted at the right (in FIGS. 1 and 2A) of the copier.

Figure 3:
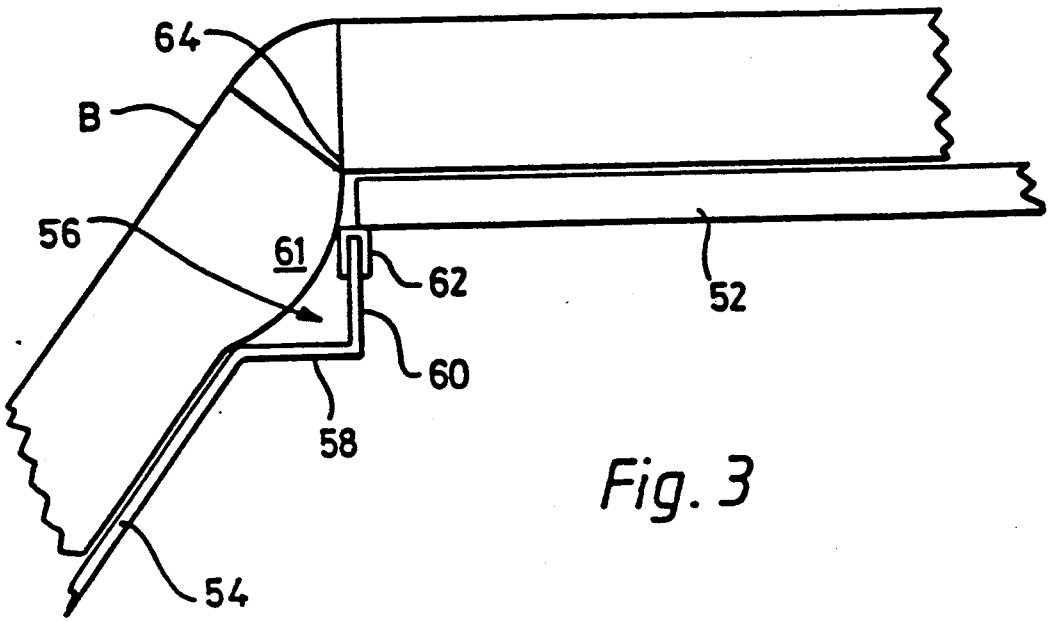
FIG. 3 shows a side view of a modified photocopier supporting a book to be copied.

Referring now to FIG. 3, there is shown a modification of the photocopier of FIGS. 1, 2A and 2B.

The half of a book B to be photocopied is shown resting on a glass platten 52 of the modified photocopier. An inclined support 54, which may be made of metal, supports the other half of the book. Along the edge between the platten 52 and the support 54 the latter forms a recess or step 56 comprising a horizontal portion 58 and a vertical portion 60. A grommet 62 fits over the end of the portion 60 and abuts the lower edge of the glass platten 52 to prevent damage to the platten.

It can thus be seen that a portion 61 of the book B adjacent the spine can expand or splay into the recess 56, thereby reducing the amount by which the portion 61 need be forced open along the spine, and enabling a page of the book to be photocopied closer to the spine.

Figure 4:
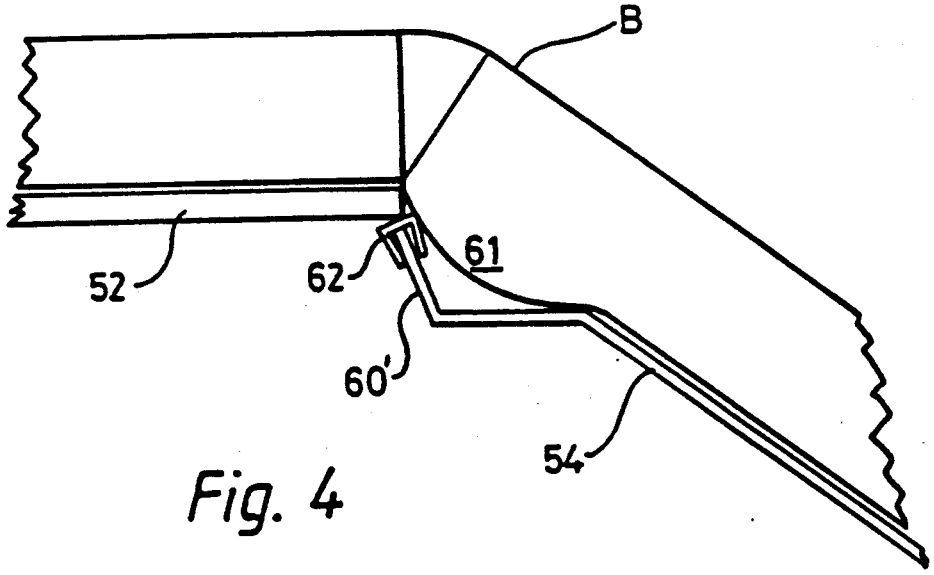
FIG. 4 shows a side view from the other end of a further modification of a photocopier with a less steeply inclined book supporting surface.

FIG. 4 is similar to FIG. 3, although the support 54 is at a shallower or less steep inclination. Here the upright portion 60 of the recess 56 is steeply inclined, since it does not require to be vertical in view of the shallower inclination of the support 54.

We claim:

1. In a copier comprising a casing and a platten mounted thereon, and in which the imaging optics and the paper feed require the original to be copied to be aligned with or referenced to the near edge of the platten, the improvement wherein said casing is cut away in the region of the near edge so as to slope outwardly and downwardly, thereby providing an inclined support surface on which the half of a book which is not being copied can rest while the other half is being copied, and wherein a recess is provided along the edge between said platten and said support surface, the recess including a horizontal portion and an upright portion extending to the platten.

2. A copier according to claim 1 in which said inclined support surface forms with said platten an included or internal angle within a range of between 110° and 140°.

3. A copier according to claim 2 in which said range is between 125° and 130°.

4. A copier according to claim 1 in which the upright portion is inclined to the platten at an included angle of approximately 110°.

5. A copier according to claim 1 in which the edge of the support surface adjacent the platten is covered by a strip or grommet.

6. A copier having a box-like casing including, from the operator's viewpoint, left, right, near and far sides and a top surface in which is mounted a platten, wherein the platten is set well back from the casing's front side, and proximate the top edge of the casing slopes away from the platten to produce a downwardly inclined book support surface which extends from the platten near edge, and wherein a recess is provided along the edge between said platten and said support surface, the recess including a horizontal portion and an upright portion extending to the platten.

7. A copier according to claim 6 in which said inclined support surface forms with said platten an included or internal angle within a range of between 110° and 140°.

8. A copier according to claim 6 in which the upright portion is inclined to the platten at an included angle of approximately 110°.

9. A copier according to claim 6 in which the edge of the support surface adjacent the platten is covered by a strip or grommet.

* * * * *